US011509062B2

(12) United States Patent
Mallegol et al.

(10) Patent No.: US 11,509,062 B2
(45) Date of Patent: Nov. 22, 2022

(54) BROADBAND WIRE ANTENNA WITH RESISTIVE PATTERNS HAVING VARIABLE RESISTANCE

(71) Applicant: THALES, Courbevoie (FR)

(72) Inventors: Stéphane Mallegol, Brest (FR); Michel Jousset, Brest (FR); Pierre Belec, Brest (FR)

(73) Assignee: THALES, Courbevoie (FR)

( * ) Notice: Subject to any disclaimer, the term of this patent is extended or adjusted under 35 U.S.C. 154(b) by 867 days.

(21) Appl. No.: 16/308,775

(22) PCT Filed: Jun. 9, 2017

(86) PCT No.: PCT/EP2017/064178
§ 371 (c)(1),
(2) Date: Sep. 3, 2019

(87) PCT Pub. No.: WO2017/212047
PCT Pub. Date: Dec. 14, 2017

(65) Prior Publication Data

US 2020/0044356 A1 Feb. 6, 2020

(30) Foreign Application Priority Data

Jun. 10, 2016 (FR) ..... 16/00944

(51) Int. Cl.
*H01Q 17/00* (2006.01)
*H01Q 9/27* (2006.01)
*H01Q 11/10* (2006.01)

(52) U.S. Cl.
CPC ..... *H01Q 17/008* (2013.01); *H01Q 9/27* (2013.01); *H01Q 11/105* (2013.01)

(58) Field of Classification Search
CPC ..... H01Q 15/0013–006; H01Q 1/36; H01Q 9/27; H01Q 9/17
See application file for complete search history.

(56) References Cited

U.S. PATENT DOCUMENTS 5,170,175 A * 12/1992 Kobus ..... H01Q 9/27 343/895
5,311,199 A 5/1994 Fraschilla et al.
(Continued)

FOREIGN PATENT DOCUMENTS

FR 3 017 493 A1 2/2014
GB 2516980 A * 2/2015 ..... H01Q 5/378
WO WO-2015136121 A1 * 9/2015 ..... H01Q 1/28

OTHER PUBLICATIONS

International Search Report of related International Patent Application No. PCT/EP2017/064178 dated Jun. 9, 2017.

*Primary Examiner* — Dameon E Levi
*Assistant Examiner* — Leah Rosenberg
(74) *Attorney, Agent, or Firm* — ArentFox Schiff LLP

(57) ABSTRACT

The invention relates to a wire antenna adapted to operate in at least one predetermined frequency band, comprising a plurality of superimposed layers, comprising at least one radiating element placed on a support layer, wherein the support layer is placed on a spacer substrate, and wherein the spacer substrate is placed on a reflector plane comprising at least one resistive layer between the support layer of the radiating element(s) and the substrate spacer, while the resistive layer comprises at least two sets of nested resistive patterns. This antenna is such that the sets of resistive patterns have resistance values gradually varying between a central antenna point and an outer edge of the antenna, in order to achieve a resistance gradient.

8 Claims, 7 Drawing Sheets

(56) References Cited

U.S. PATENT DOCUMENTS

| | | | | |
|---|---|---|---|---|
| 5,576,710 | A * | 11/1996 | Broderick | H01Q 17/00 342/1 |
| 5,694,136 | A | 12/1997 | Westfall | |
| 5,748,152 | A | 5/1998 | Glabe et al. | |
| 7,403,152 | B2 * | 7/2008 | Gustafsson | H01Q 1/52 342/1 |
| 2008/0316124 | A1 | 12/2008 | Hook | |

* cited by examiner

BROADBAND WIRE ANTENNA WITH RESISTIVE PATTERNS HAVING VARIABLE RESISTANCE

CROSS-REFERENCE TO RELATED APPLICATIONS

This application is a National Stage Entry of International Patent Application PCT/EP2017/064178, filed Jun. 9, 2017, which claims priority to French Patent Application No. 16/00944, filed Jun. 10, 2016. The disclosure of the priority application incorporated in their entirety herein by reference.

The present invention relates to a wire antenna capable of operating in at least one predetermined frequency band, comprising a plurality of superimposed layers.

The invention finds applications in particular in the field of electromagnetic listening systems.

In an electromagnetic listening system, for example airborne or naval, the antennas, which are used either singly or in a goniometric network, must operate in a very wide frequency band and in a circular polarization, linear or double linear, respectively corresponding to the ranges of interest in frequency and in polarization of the electromagnetic signals. It should be noted that as the characteristics of an antenna are the same in reception and transmission, an antenna may be characterized either in transmission or in reception.

These antennas must have the smallest possible footprint and, in particular, a small thickness, in order, in particular, to be more easily integrated on carriers. They must also offer radiation performance (gain, quality of radiation patterns, etc.) that is reproducible from one antenna to another, in particular for network applications, or to allow replacement during a maintenance operation.

In this context, it is known to use wire antennas. In such an antenna, the radiating element consists of a wire which is shaped to describe a pattern of the spiral type or the log periodic type in a so-called radiation surface.

In a spiral type antenna, the wire is wound upon itself in order to form a spiral view in a plan view. This spiral may, for example, be an Archimedean spiral, a logarithmic spiral, or other.

In a log-periodic antenna, the wire is shaped in order to comprise several strands in a plan view. Each strand is inscribed in an angular sector that extends radially and has indentations. The length of each tooth and the distance between two successive teeth of a strand follow a logarithmic progression.

In practice in planar technology, the radiating element is produced by etching a thin metal layer, for example a copper layer with a thickness of between 2 and 20 μm (micrometers), deposited on a thin support layer.

A first type of wire antenna with an absorbent cavity is known in the prior art, wherein the radiating element that is etched on a planar or shaped radiation surface, is situated above an absorbent cavity delimited by metal walls and filled with a material absorbing electromagnetic waves. The radiating element is capable of emitting a wave that propagates towards the front of the radiating surface (away from the absorbent cavity) and a wave that propagates towards the rear of the radiating surface (towards the absorbent cavity). The latter is absorbed by the absorbent cavity.

Such an antenna has a large footprint because of the dimensions of the absorbent cavity. It also has low efficiency since half of the power emitted by the radiating element is absorbed in the absorbent cavity. Finally, the reproducibility of the radio performance of such an antenna is difficult to achieve because of a lack of control of the electromagnetic characteristics of the absorbent material filling the cavity.

In a second type of wire antenna according to the prior art, the radiating elements are placed on a Loaded Electromagnetic Band Gap (LEBG) on a lower ground plane. In such an antenna, a surface composed of periodic metal patterns connected by resistors is placed in the cavity of the antenna. In this antenna, the wave emitted backwards by the radiating element is absorbed in a thin layer consisting of a metallic reflector plane surmounted by metal and LEBG material loaded by resistors.

This solution makes it possible to obtain broadband antennas of small thickness and offering improved radiation stability. However, because of the absorption of surface currents, the radiation performance is similar to that of the absorbent cavity antennas.

In a third type of wire antenna of the prior art, the radiating element, etched on a plane radiation surface, is located above a reflector plane of metal. In this antenna, the wave emitted towards the rear of the radiating surface by the radiating element is reflected towards the front by the reflector plane. During this reflection, the wave is out of phase by an angle Tr. The reflected wave propagates forwards and interferes, beyond the radiation surface, with the wave radiated forwards by the radiating element. This interference is constructive when, for a given position of the wavefront, the phases of the waves emitted towards the front and reflected towards the front are close. This occurs if the distance between the radiating surface and the reflector plane is close to $\lambda/4$, where $\lambda$ is the wavelength in the propagation medium corresponding to the frequency of the transmitted wave.

The thickness of such an antenna is reduced compared to that of an absorbent cavity antenna. In addition, its manufacture is greatly simplified and is reproducible.

However, the frequency band of such an antenna is restricted because of the relationship between the operating frequency of the antenna and the distance between the radiating surface and the reflector plane. In addition, the multiple interactions between the radiating element and the lower ground plane cause degradation of the radiation patterns of the antenna, rendering them unusable for amplitude direction finding applications, for example.

In a fourth type of wire antenna of the prior art, the radiating element is etched on a high impedance surface (HIS), based on spaced periodic metal patterns, placed in the antenna cavity and connected to the ground plane by metallized links, also called vias. The efficiency band of such an antenna in which the interference between the incident wave and the reflected wave is constructive, substantially corresponds to an octave. Therefore, this type of antenna is limited to narrow bands of operation, and does not simultaneously cover a multi-octave frequency band.

In a fifth type of wire antenna of the prior art, the radiating element, etched on a plane radiation surface, is disposed above a plane of a perfect magnetic conductor (PMC) material. In this antenna, the wave emitted by the radiating element towards the rear of the radiating surface is reflected towards the front by the PMC material with zero phase shift. This rearwards reflected wave interferes, beyond the radiation surface, with the wave emitted forwards by the radiating element. This interference is constructive provided that, for a given wavefront position, the phases between the waves transmitted forwards and reflected forwards are close. This condition is fulfilled if the distance between the radiating surface and the plane PMC is very small compared to the wavelength A. The thickness of such an antenna is greatly reduced compared to that of an absorbent cavity antenna.

However, the frequency band that is accessible by means of such an antenna is restricted. In fact, if the distance between the radiating surface and the PMC plane is chosen very small, there is a limitation at low frequencies because of a sharp decrease in impedance and the establishment of a short circuit between the radiating element and the PMC plane. On the other hand, if this distance is chosen to be larger for each operating frequency so that $\lambda/4$ is a multiple of the distance between the radiating surface and the PMC plane, the power radiated towards the front of the radiating surface is null.

In a sixth type of wire antenna of the prior art, the radiating elements are placed on a progressive magneto-dielectric substrate. In a seventh antenna with radiating elements of the prior art, the radiating elements are placed on a dielectric substrate of high relative permittivity and pierced with thin vertical holes.

However, it has been found that these two types of antennas have the disadvantage of a very frequency-dependent radiation pattern. More particularly, the angular aperture of the radiation lobe (half-power aperture, for example) varies very rapidly with frequency.

Finally, an eighth type of wire antenna of the prior art comprises, interposed between the radiating element in question and the lower metal reflector plane (or ground plane) of the cavity, a layer consisting of resistive units with a fixed resistance value, arranged in the so-called radiation zone in the near field of the radiating element or elements. The resistive patterns form a partial resistance layer, wherein spaces are arranged between neighboring patterns, and may be made from a resistive ink.

Such an antenna offers a small footprint, good performance and a stable radiation pattern. In addition, this solution provides an improvement in the polarization axis gain that is adapted to the first and second antennas mentioned above, wherein this gain may be typically improved by about 5 dB (decibels).

However, this type of antenna has a significant decrease in the polarization axis gain adapted for low frequencies, while the axial ratio, in the case of a spiral antenna, remains degraded for low frequencies, typically greater than 3 dB for frequencies below 1 GHz (GigaHertz), which reflects a non-circular character of the polarization of the electromagnetic wave at these frequencies.

The axial ratio is conventionally given by the following formula, wherein $E\theta$ and $E\varphi$ denote the electric field components along the main axes of the reference frame in question:

$$AR = \sqrt{\frac{|E_\theta|^2 + |E_\varphi|^2 - |E_\theta^2 + E_\varphi^2|}{|E_\theta|^2 + |E_\varphi|^2 + |E_\theta^2 + E_\varphi^2|}}$$

An axial ratio typically less than 3 dB (theoretical circular polarization: axial ratio of 1, i.e. 0 dB) is sought for a circularly polarized antenna, The aim of the invention is to correct the aforementioned problems by proposing a high gain, low axial ratio, wire antenna offering stable radiation patterns over a wide frequency band.

For this purpose, the invention proposes a wire antenna capable of operating in at least one predetermined frequency band, comprising a plurality of superimposed layers, comprising at least one radiating element placed on a support layer, wherein the support layer is placed on a spacer substrate, while the spacer substrate is placed on a reflector plane, comprising at least one resistive layer between the support layer of the radiating element(s) and the spacer substrate, wherein the resistive layer comprises at least two sets of nested resistive patterns. This antenna is such that the sets of resistive patterns have resistance values that vary progressively between a central antenna point and an outer edge of the antenna in order to achieve a resistance gradient.

Advantageously, the wire antenna according to the invention allows optimal interaction between the radiating element(s) and the reflector plane or ground plane, over a widest possible frequency band.

Advantageously, the wire antenna according to the invention may have one or more of the following characteristics, taken independently or in combination, in any technically feasible combination.

The antenna comprises a first continuous peripheral resistive portion disposed in a peripheral zone of the resistive layer and surrounding the resistive pattern set(s) of the resistive layer.

The first continuous peripheral resistive portion has a circular or square crown shape.

The antenna comprises a second continuous peripheral resistive portion disposed on the support layer of the radiating element and surrounding the radiating element, wherein the second portion has shape and resistance characteristics that are similar to the characteristics of the first continuous peripheral resistive portion.

The antenna comprises a plurality of sets of resistive patterns, wherein each set of resistive patterns is composed of non-contiguous elementary resistive patterns and has an associated resistance value, wherein the resistance value is the same for all the elementary resistive patterns of a set of resistive patterns.

The antenna comprises a plurality of sets of resistive patterns, wherein each set of resistive patterns is composed of non-contiguous elementary resistive patterns, and wherein each elementary resistive pattern has a resistance value gradually varying over its surface, wherein the resistance variation has the same sense of resistance variation as that of the gradual variation between the central antenna point and the outer edge of the antenna.

All the elementary resistive patterns of the same set of patterns have the same geometric shape and are regularly spaced.

The sets of resistive patterns are concentric and have a square or circular topology.

The resistive patterns are made in resistive ink.

The antenna comprises a plurality of resistive layers with sets of nested resistive patterns with resistance values that gradually vary between an antenna central point and an outer edge of the antenna, wherein two successive resistive layers are separated by at least one substrate layer.

Other characteristics and advantages of the invention will emerge from the description which is given below, by way of indication and in no way limitative, with reference to the appended figures, among which:

Figure 1:
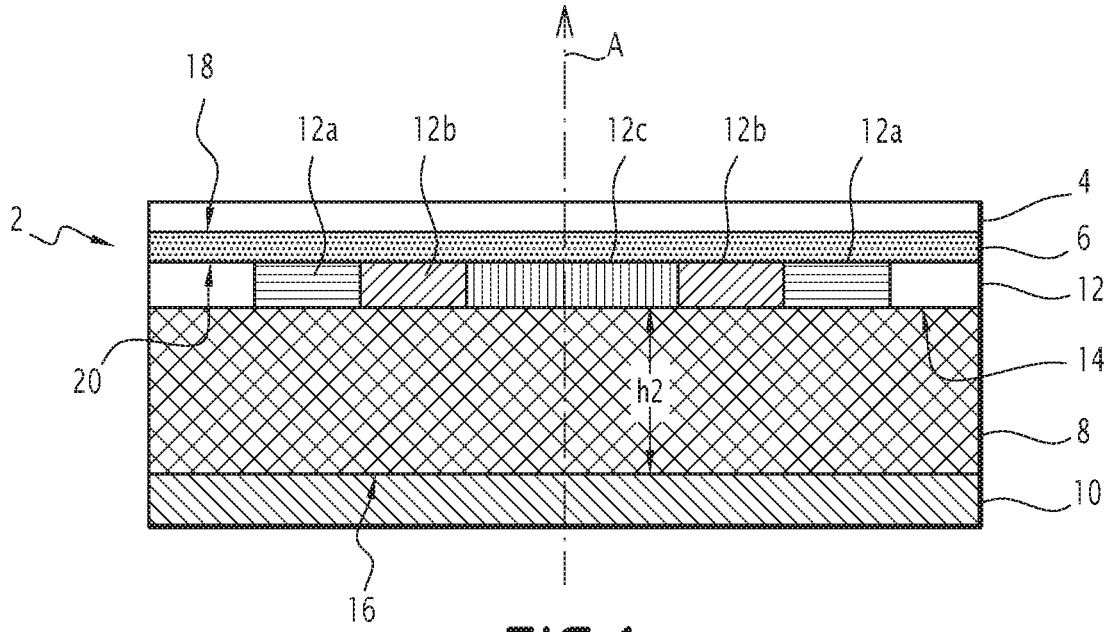
FIG. 1 shows a cross-sectional view of a wire antenna according to a first embodiment of the invention.
Figure 2:
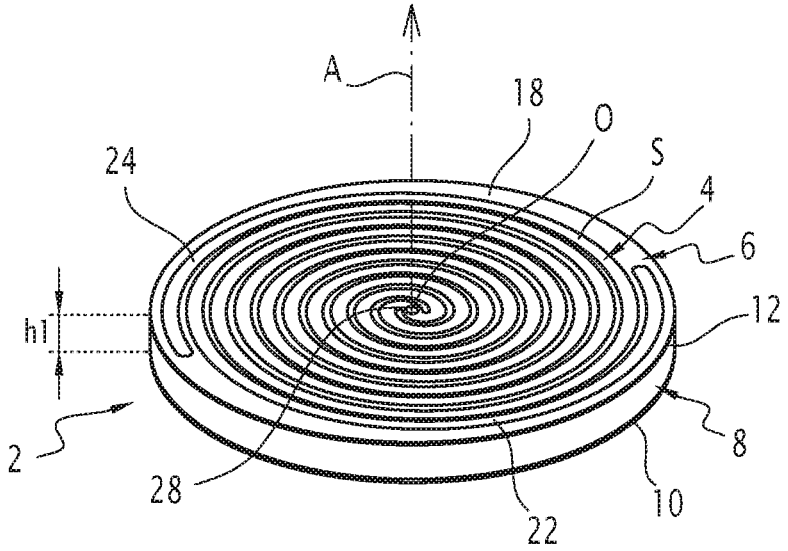
FIG. 2 shows a perspective representation of a wire antenna according to FIG. 1.

FIGS. 1 and 2 respectively show a cross-sectional view and a perspective view of a wire antenna 2 according to a first embodiment of the invention.

In this embodiment, the wire antenna 2 is a broadband antenna capable of operating over a decade, for example, typically in a frequency range of 1 GHz to 10 GHz.

In this embodiment, the wire antenna 2 is in the form of a disk of circular circumference C, of center O and several concentric layers stacked along an axis A.

A radiating element 4, disposed on a flat surface S, also called a radiation surface, is placed on a planar support layer 6 forming a first substrate, which is itself disposed above a second spacer substrate 8.

The first substrate 6 is made of a dielectric material with a given relative permittivity. For example, the first substrate may be made of a dielectric material of low relative permittivity (e.g. foam) or a dielectric material of the Duroid type (trademark) or a possibly multilayer composite material.

Alternatively, the first substrate may be made of a pure magneto-dielectric or magnetic material.

According to another variant, the first substrate 6 is made of a progressive or pierced dielectric material that is recessed at its center, in order to achieve increasing relative permittivity from the center to the outer edge of the antenna.

The spacer substrate 8 is disposed on a reflector plane 10. The reflector plane 10 is preferably metallic, and is situated at a distance h1 below the radiation surface S. It has the function of reflecting any incident wave whatever its frequency in a given frequency interval.

Alternatively, the metal reflector plane 10 need not be full but may have perforations, for example slits.

The spacer substrate 8 has the general external shape of a flat cylinder around the axis A and of substantially constant thickness h2.

The thickness h2 of the spacer substrate 8 is greater than the thicknesses of the other layers forming the antenna 2, and forms an antenna cavity.

Preferably, the thickness h2 is so chosen that the total thickness of the antenna satisfies without the resistive patterns, has the following phase shift relationship that reflects a constructive interference (in terms of electromagnetic waves) between the radiating circuit and the reflector plane (phase shift between −120° and +120°):

$$-2\beta H + \pi = 0$$

$$\beta = 2\pi F \frac{\sqrt{\varepsilon_{eff} \cdot \mu_{eff}}}{c}$$

wherein H is the overall thickness of the antenna, function of h2. The term F designates the frequency. The term c represents the speed of propagation of the waves in the vacuum, while $\varepsilon_{eff}$ and $\mu_{eff}$ respectively denote the effective relative permittivity and the effective relative permeability, a function of the constituent materials of the antenna.

This spacer substrate 8 is made of a dielectric material of given permittivity. For example, the spacer substrate may be made of a dielectric material of low relative permittivity (e.g. foam) or a dielectric material of the Duroid type (trademark) or, possibly, a multilayer composite material.

Alternatively, the spacer substrate 8 may be made of a pure magneto-dielectric or magnetic material.

In an alternative embodiment, the spacer substrate 8 is made of a progressive or pierced dielectric material, recessed at its center, in order to achieve a relative permittivity that increases from the center to the outer edge.

A resistive layer 12 is arranged between the support layer 6 and the spacer substrate 8, with regular resistive patterns on at least one crown of center O.

The resistive layer 12 is composed of a plurality of sets 12*a*, 12*b*, 12*c* of resistive patterns having different resistance values, which vary progressively between the antenna center point O and an outer edge C of the antenna.

In the first embodiment illustrated in FIGS. 1 and 2, the set of patterns 12*c* is placed centrally about the axis A of the antenna, while the set of patterns 12*b* is placed around the set of patterns 12*c*, and the set of patterns 12*a* is placed around the set of patterns 12*b*.

Thus, the sets of patterns are concentric and nested.

The number of sets of patterns forming the antenna is not limited.

According to a first embodiment, the resistive layer 12 is disposed on a first face 14, or upper face, of the spacer substrate 8, oriented towards the radiating element 4, and opposite the second face 16, or lower face, in contact with the metal reflector 10.

According to a second variant embodiment, the resistive layer 12 is disposed on a second face 20 or lower face of the support layer 6, while the radiating element 4 is disposed on the first face 18 or upper face of the support layer 6.

The resistive layer 12 is disposed in a zone close to the radiating element 4, spaced apart from the reflector plane 10 by the spacer substrate 8 with a thickness h2.

Preferably, the resistive layer 12 is made from a resistive ink by screen printing, wherein the resistive patterns are deposited on the support surface chosen according to the first or second variant described above.

In the case of a resistive ink deposit through screen printing, a resistive ink having a resistivity characteristic expressed in Ω per square is used.

The radiating element 4 comprises first and second metal wires 22 and 24 that are respectively shaped in a spiral type pattern or sinuous log-periodic type pattern, for example. More particularly, the pattern forms an Archimedean spiral in the embodiment of FIG. 1.

Each wire, 22, 24, is wound around the point of origin O, which corresponds to the intersection of the axis A and the radiation surface S.

The radiating element 4 is, for example, made by an etching operation, directly on the upper face 18 of the support layer 6.

A supply device (not shown) for the radiating element 4 is placed below the reflector plane 10, which is electrically connected to ground. The reflector plane 10 and the layers 8, 12, 6 placed above it are provided with a hollow passage 28 along the axis A, for the passage of a conductor wire to be connected to the radiating element 4 in order to power the latter electrically.

In operation, an active zone of the radiating element 4 emits a first direct wave propagating forwards, i.e. away from the spacer substrate 8, and a second wave propagating towards the rear, i.e. in the direction of the spacer substrate 8.

The second wave passes through the resistive layer 12, the spacer substrate 8, is reflected by the reflector plane 10, and then again passes through the spacer substrate 8, and the resistive layer 12.

The resistive layer 12 comprises resistive patterns arranged in several sets, wherein each set is disposed on at least one crown with the center O.

Figure 3:
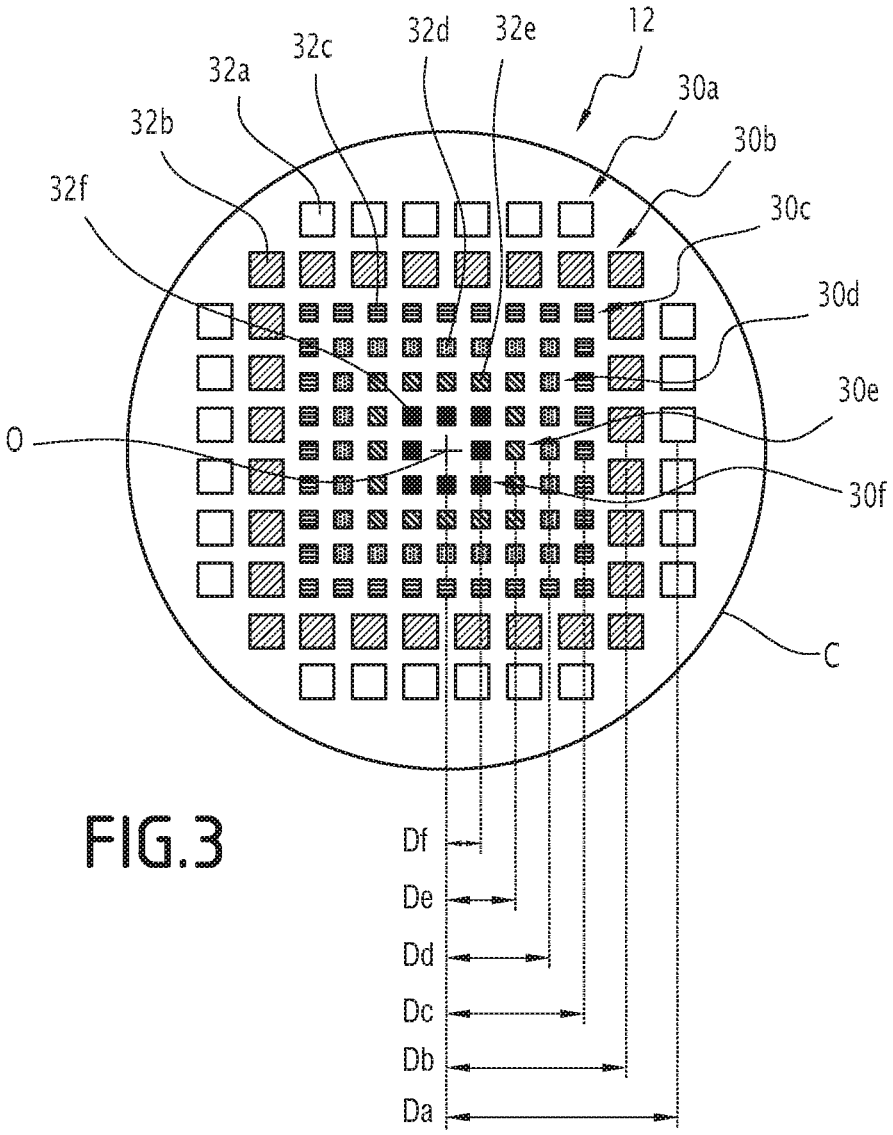
FIG. 3 shows a view from above of the resistive layer according to a first embodiment.

FIG. 3 shows an embodiment of the resistive layer 12, when the antenna has the shape of a disk with a circumference C.

In this embodiment, the resistive layer comprises six sets of resistive patterns, 30*a* to 30*f*, wherein each set of patterns is formed by elementary resistive patterns 32*a* to 32*f*, while the set 30*a* is closest to the outer edge C, and the set 30*f* is closest to the center O of the antenna.

More generally, 30*n* is a set of resistive patterns, and 32*n* an associated elementary resistive pattern. The size of the elementary resistive patterns of two sets of different patterns may be the same or different as shown in FIG. 3.

The elementary resistive patterns are also square and evenly spaced.

In the exemplary embodiment illustrated, the elementary resistive patterns 32*n* of one and the same set of patterns 30*n* have the same size and the same resistance value Rn, referred to as the resistance value associated with the set of patterns 30*n*. Two sets of adjacent patterns have different resistance values, and therefore the sets of resistive patterns are frequency selective. In other words, the gradual difference in resistance value between sets of adjacent patterns, coupled with the fact that a spiral antenna has a frequency-dependent near-field radiation region, produces a frequency-selective effect.

The resistance values are chosen to vary gradually between an antenna center point O and the periphery of the antenna, in order to achieve a resistance gradient.

A resistance gradient is here called a variation of the resistance values between a minimum value and a maximum value. The gradient is substantially continuous if the variation is almost monotone.

For example, the minimum resistance value is the value associated with the set of resistive patterns 30*a*, located at the periphery of the antenna, while the maximum resistance value at the set of resistive patterns 30*f* is closest to the center O.

In a nonlimiting example, the resistance values in ohms (Ω) are as follows, while denoting $C_i$ as the square corresponding to the elementary resistive pattern 32*i*.

Ra=1000 $\Omega/C_a$; Rb=5000 $\Omega/C_b$; Rc=10000 $\Omega/C_c$; Rd=15000 $\Omega/C_d$; Re=20000 $\Omega/C_e$; Rf=30000 $\Omega/C_f$.

It should be noted that the resistive patterns have a geometric shape and a thickness, and are made of a resistive material, which is a resistive ink in the case of a screen printed deposit, wherein it has a given resistivity value ρ, expressed in Ω·m. The effective resistance obtained for a pattern, for example for a square-shaped pattern of with a side a and a thickness e, taken between two opposite sides of the square, is:

$$R = \frac{\rho}{e} \text{ (in } \Omega)$$

Figure 4:
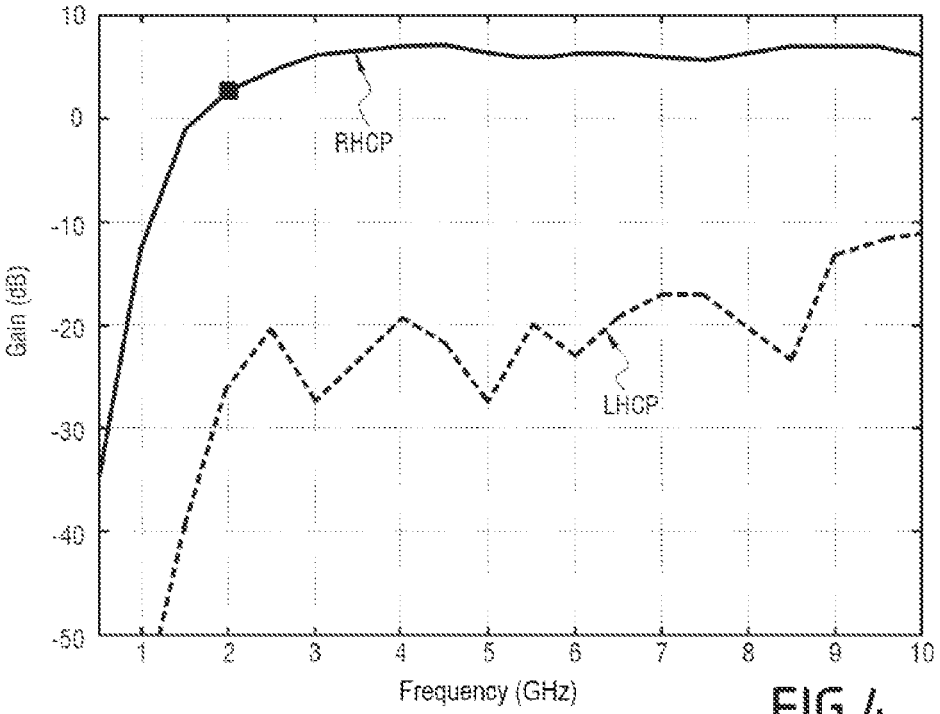
FIGS. 4 and 5 illustrate performances of an exemplary antenna according to the first embodiment.
Figure 5:
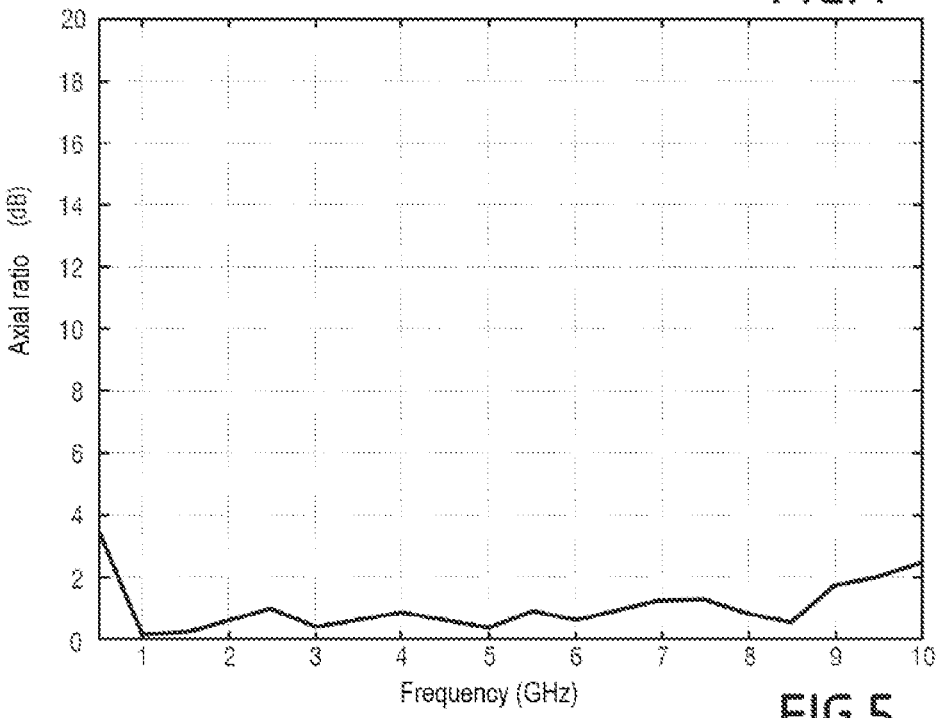

FIGS. 4 and 5 illustrate the radio frequency performance of an antenna having the following characteristics:

- a radiating element with a diameter of 120 mm, and a two-strand Archimedean spiral type, is etched on a first substrate 6 made of a dielectric material of the type RO4350 (registered trademark) with a thickness of 0.254 mm;
- a layer 12 formed by six sets of resistive patterns as described above, arranged at 0.254 mm from the radiating element;
- a spacer substrate 8 of the low constant dielectric foam type, with a thickness h2=10 mm;
- a lower reflector plane 10.

The elementary resistive patterns 32*a*, 32*b* are square with a side equal to $0.098\lambda_{Fc}$, while the resistive patterns 32*c*-32*f* are square with a side equal to $0.049\lambda_{Fc}$, wherein $\lambda_{Fc}$ is the wavelength in the vacuum, at the central frequency of the operational frequency band of the antenna (in this case, 0.8 GHz to 10 GHz). The central frequency is calculated as the arithmetic mean of the extreme frequencies of the frequency band.

Each set of patterns 30*i* is formed by square elementary resistive patterns, wherein the center of each elementary square is disposed on the contour of a support square associated with the set of patterns 30*i* having a side equal to 2Di, wherein the respective values of Di are as follows: Da=$0.662\lambda_{Fc}$; Db=$0.515\lambda_{Fc}$; Dc=$0.392\lambda_{Fc}$; Dd=$0.294\lambda_{Fc}$; De=$0.196\lambda_{Fc}$; Df=$0.098\lambda_{Fc}$. The neighboring elementary resistive patterns of the same set of patterns are spaced apart by $0.049\lambda_{Fc}$ in the vertical and/or horizontal direction(s).

The shape and size are variable and defined, for each embodiment, using 3D electromagnetic simulation software or electromagnetic simulator, during an electromagnetic optimization step.

In general, given the antenna size (cavity size and thickness), the set of materials of the various layers, the number and a topology of the sets of resistive patterns, and the associated resistance values, it is possible, using 3D electromagnetic simulation software, to calculate the size of the patterns and the spacing of the patterns to optimize the radio frequency performance obtained.

Such simulation software is known, for example software that solves the Maxwell equations in integral form, using the finite integral method.

The size and topology of the patterns are chosen to improve the stability of the radiation pattern.

Given a support substrate height 6, a height of the spacer substrate 8 and relative permittivity values of the dielectric substrate materials, the choice of the values of the resistors associated with the sets of patterns of the resistive layer 12 and the shape of the patterns is guided by a compromise between the far-field gain radiated in the radio axis, and thus the radiation efficiency and the shape or stability of the radiation pattern (angular aperture of the lobe according to the frequency) is determined.

The choice of the various values of resistance, elementary pattern size and associated distances, is effected by implementing several simulations and comparing the results in order to select the values and patterns best suited for a targeted application.

FIG. 4 shows the axis gain expressed in decibels as a function of frequency, for a right-hand circular polarization (RHCP) and a left-hand circular polarization (LHCP) for the above detailed exemplary antenna (with theoretical adapted RHCP).

FIG. 5 shows the axial ratio, which is the ratio in the radio axis, in decibels, as a function of frequency.

The frequency band in question is [0.5 GHz-10 GHz].

These figures illustrate an improvement in the adapted polarization axis gain at the bottom of the frequency band in question with respect to an antenna with resistive patterns of fixed constant resistance value. A gain of +6 dB is found at 0.5 GHz, +15 dB at 1 GHz, and +4 dB at 2 GHz. Above 5 GHz, the axis gain is similar to that obtained with an antenna with resistive patterns of a fixed constant resistance value.

There is also an improvement in cross polarization at the bottom of the frequency band, wherein the axial ratio passes, for example, from 13.5 dB to about 3.5 dB in the very low frequencies (less than 0.5 GHz), which induces an improvement in the purity of the circular polarization of the antenna at low frequencies.

In addition, the radiation patterns are stable.

The first embodiment has been described above with a topology of resistive patterns arranged in a square and formed by square elementary resistive patterns.

Variations of the topology of the patterns are conceivable.

According to one variant, the resistive layer comprises sets of concentric resistive patterns, wherein square the elementary resistive patterns units are of the same size and are regularly arranged radially and angularly to form rings centered on O. The topology is referred to as radial topology.

Figure 6:
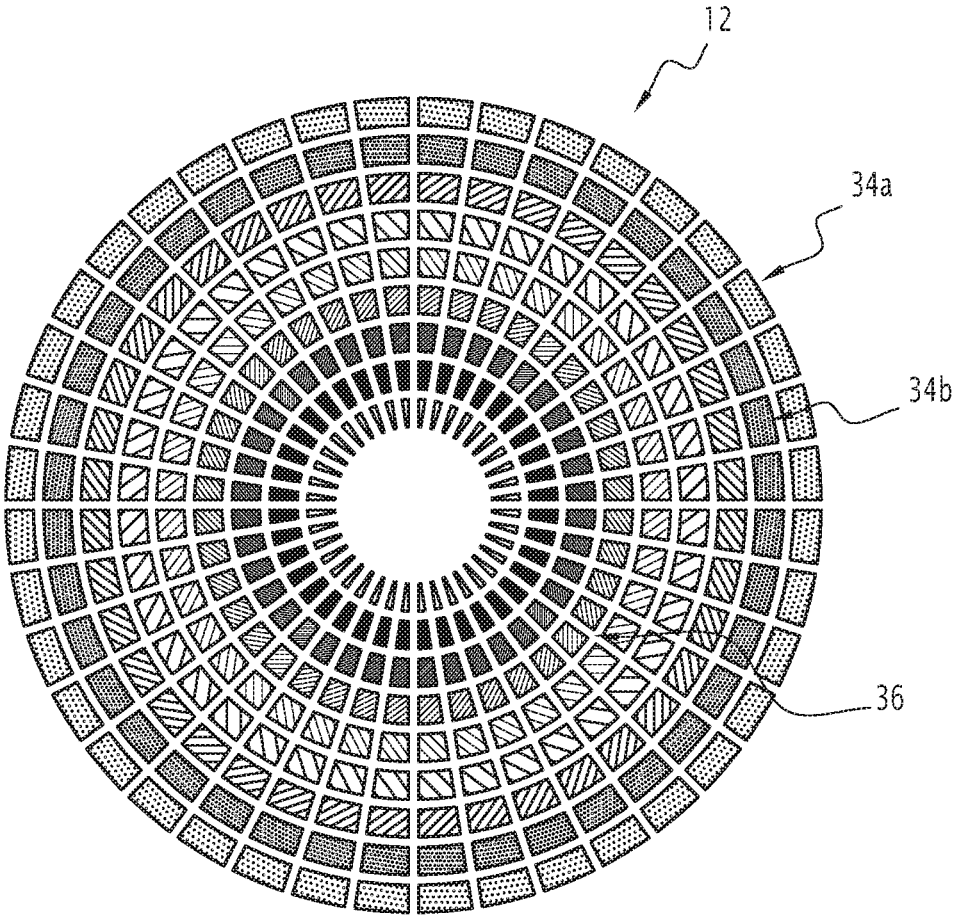
FIG. 6 shows a view from above of the resistive layer according to a variant of the first embodiment.

According to another variant, schematically illustrated in FIG. 6, the sets of patterns have a radial topology, distributed in concentric rings 34*a*, 34*b*, . . . , wherein each is formed by elementary patterns 36, which are portions of a ring in the form of an isosceles trapezoid. For example, each set of ring patterns comprises regularly spaced patterns of the same dimensions, while the dimensions of the patterns in the ring vary according to the radius of the ring, thus the distance from the center O.

The first embodiment has been described above with sets of elementary patterns, wherein each set of elementary patterns has an associated resistance value, while the resistance value is the same for each elementary resistive pattern of the set.

According to one variant, a resistance gradient is applied for each elementary resistive pattern, which makes it possible to produce a resistance gradient within each set of patterns. When the intra-pattern resistance gradient evolves in the same direction as the intra-pattern resistance gradient, the transition between adjacent resistive patterns is even more gradual. It is then possible to produce a quasi-monotonic resistance gradient between the center and the periphery of the antenna.

The first embodiment has been described above with reference to FIGS. 3 to 6 with sets of resistive patterns forming a resistance gradient that increases from the periphery of the antenna to its center.

Alternatively, it is also conceivable to form a resistance gradient which increases from the center of the antenna towards its periphery.

For example, the resistance values in ohms (Ω) of the elementary resistive patterns of FIG. 3 are then: Rf=1000 $\Omega/C_f$; Re=5000 $\Omega/C_e$; Rd=10000 $\Omega/C_d$; Rc=15000 $\Omega/C_c$; Rb=20000 $\Omega/C_b$; Ra=30000 $\Omega/C_a$.

Such an alternative makes it possible to favor the circular nature of the polarization of the electromagnetic wave, wherein the axial ratio becomes less than 2 dB over the entire frequency band in question.

Figure 7:
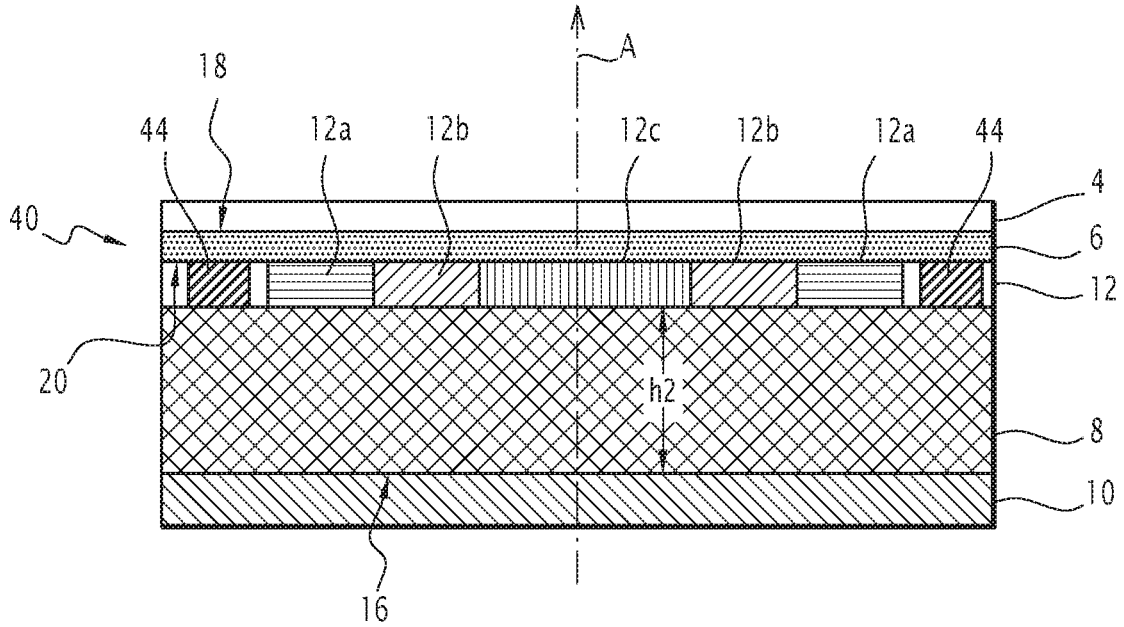
FIG. 7 shows a cross-sectional view of a wire antenna according to a second embodiment of the invention.
Figure 8:
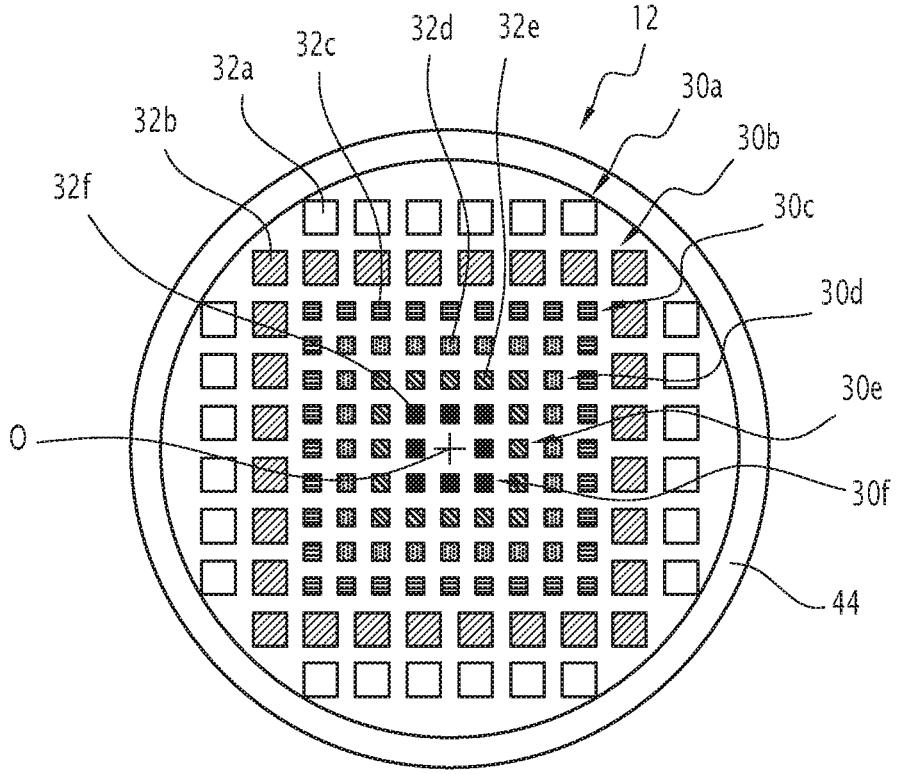
FIG. 8 shows a top view of an implementation of a wire antenna according to FIG. 7.

FIG. 7 shows a cross-sectional view of a wire antenna 40 according to a second embodiment of the invention. FIG. 8 shows a view from above of an embodiment of the resistive layer 12 of the wire antenna 40.

The common elements of the antenna 40 and the antenna 2 of the first embodiment are denoted by the same references, and are not described further.

The resistive layer comprises sets of resistive patterns of variable resistance as described above and also comprises, in this second embodiment, a continuous peripheral resistive portion 44 surrounding the sets of resistive patterns.

Advantageously, this resistive portion is produced by the same method as that of the sets of resistive patterns, for example by screen printing, aerosol deposition or 3D printing.

The continuous peripheral resistive portion 44 is, analogously to the sets of resistive patterns, either disposed on the first face 14, or upper face, of the spacer substrate 8, or disposed on the second face 20, or lower face, of the support layer 6.

Preferably, the resistance value of the continuous peripheral resistive portion 44 is equal to the resistance value of the peripheral assembly of resistive patterns, for example the set 12*a* of FIG. 7 or the set 30*a* of FIG. 8.

Preferably, the continuous peripheral resistive portion 44 has a ring shape for a circular antenna.

Alternatively, the continuous peripheral resistive portion 44 may have a square crown shape.

More generally, the shape of the continuous peripheral resistive portion 44 is a function of the shape of the antenna cavity.

For example, it may have a thickness dimension along the axis A of, for example, between 10 and 20 μm and a width in the plane of the resistive layer of the order of several mm, for example 6 mm.

Preferably, the continuous peripheral resistive portion 44 is joined to the peripheral elementary resistive patterns of the antenna 40, as illustrated in FIG. 8.

The addition of such a continuous peripheral resistive portion 44 allows an improvement in the axial ratio at the bottom of the frequency band compared to that obtained without a peripheral resistive portion. For example, at 0.5 GHz, the axial ratio increases to 2.2 dB, and remains unchanged for higher frequencies. In addition, no regression of the axis gain in adapted polarization is observed.

Advantageously, this second embodiment allows a low axial ratio and a large gain in suitable polarization.

It should be understood that this second embodiment may be combined with all the variants of the first embodiment described above.

Figure 9:
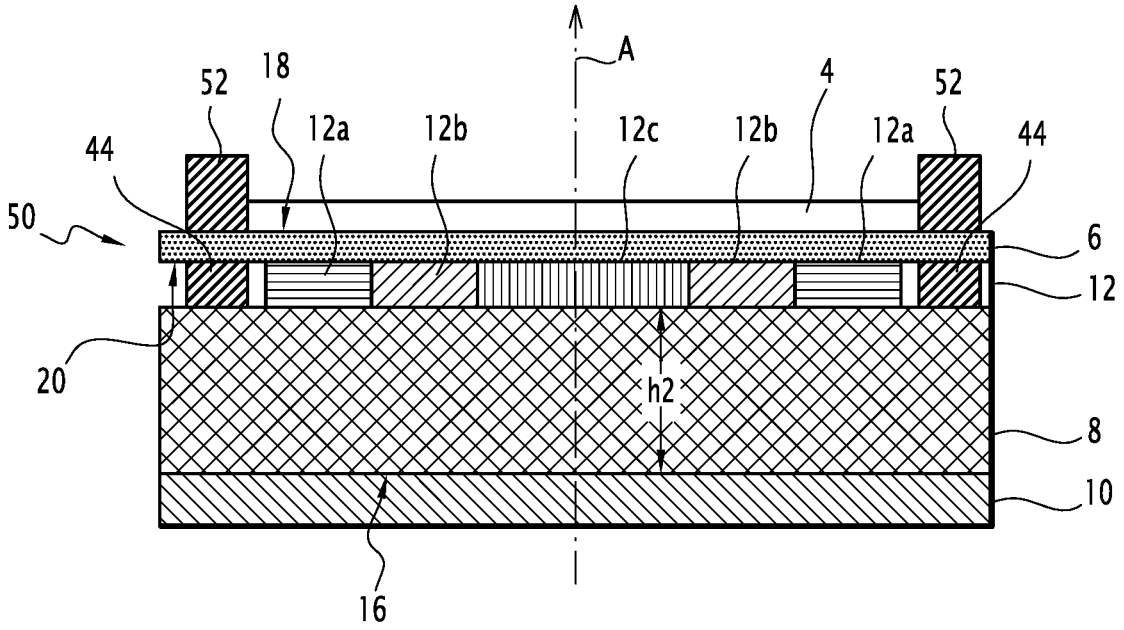
FIG. 9 shows a cross-sectional view of a wire antenna according to a third embodiment of the invention.

FIG. 9 shows a cross-sectional view of a wire antenna 50 according to a third embodiment of the invention.

The common elements of the antenna 50 with the antennas 2, 40 already described are designated by the same references, and are not described further.

In addition to the elements previously described, a second continuous peripheral resistive portion 52 is added as a supplement to the first continuous peripheral resistive portion 44.

This second continuous peripheral resistive portion 52 is added on the upper face 18 of the first substrate, on the same side as the radiating element 4.

Preferably, the second continuous peripheral resistive portion 52 surrounds the radiating element and has the same shape and resistive characteristics as the first continuous peripheral resistive portion 44.

Advantageously, this second continuous peripheral resistive portion 52 makes it possible to improve the axial ratio at the bottom of the frequency band of the antenna, by making it possible to control the end-of-strand effects of the radiating element 4 in an open circuit. Typically at 0.5 GHz, the axial ratio increases to 1.6 dB, and remains unchanged for higher frequencies.

The stability of the antenna pattern is maintained.

Figure 10:
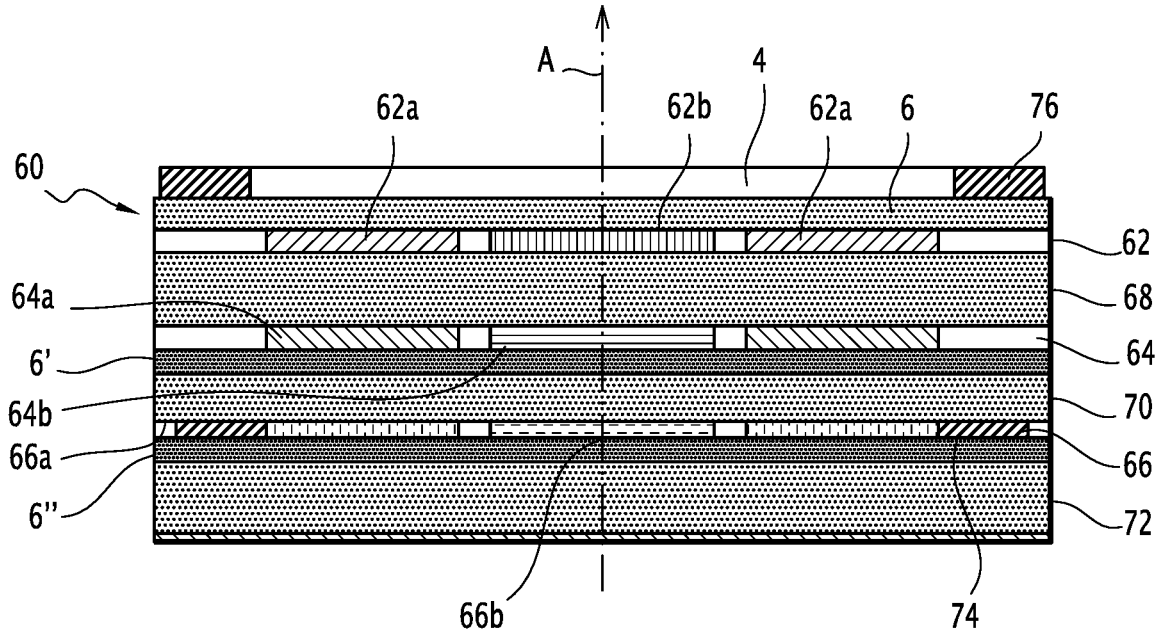
FIG. 10 shows a cross-sectional view of a wire antenna according to a fourth embodiment of the invention.

FIG. 10 shows a cross-sectional view of a wire antenna 60 according to a fourth embodiment of the invention.

In this fourth embodiment, the antenna 60 comprises a plurality of resistive pattern layers having a progressive variation that forms a resistance gradient.

In FIG. 10, three resistive layers 62, 64, 66 are illustrated, separated by substrate layers 68, 70, 72.

As explained above, to form a given resistive layer, the sets of resistive patterns are either deposited on the upper face (facing the radiating element) of the substrate located below and along the axis A, or on the lower face (facing the reflector plane) of the substrate located above it along axis A.

The structuring into a plurality of layers allows an improvement of the polarization gain adapted to the antenna, mainly in the lower part of the frequency band, and a better stabilization of the radiating patterns.

With reference to FIG. 10, an antenna 60 is illustrated comprising:

- a radiating element with a diameter of 120 mm, of a two-strand Archimedean spiral type, etched on a first substrate 6 made of a 0.254 mm thick RO4350 type dielectric material;
- a first resistive layer 62, consisting of two sets 62*a*, 62*b* of resistive patterns consisting of non-contiguous square elementary patterns with respective resistances of 20000 Ω/square, and 30000 Ω/square;
- a first foam-type spacer substrate 68 with a low dielectric constant, with a thickness of 2.75 mm;
- a second resistive layer 64, consisting of two sets of resistive patterns 64*a*, 64*b* consisting of non-contiguous square elementary patterns with respective resistances of 10000 Ω/square and 15000 Ω/square;
- a second substrate 6' made of dielectric material of the RO4350 type (registered trademark) with a thickness of 0.254 mm;
- a second foam-type spacer substrate 70 with a low dielectric constant, with a thickness of 2.75 mm;
- a third resistive layer 66, consisting of two sets of resistive patterns 66*a*, 66*b* consisting of non-contiguous square elementary patterns with respective resistances of 1000 Ω/square and 5000 Ω/square;
- a third substrate 6" of dielectric material of the RO4350 type with a thickness of 0.254 mm;
- a third spacer substrate 72 of the foam type with a low dielectric constant, with a thickness of 2.75 mm;
- a reflector plane 10.

Peripheral resistive portions 74, 76 are also added, with 1000 Ω/square resistance.

Figure 11:
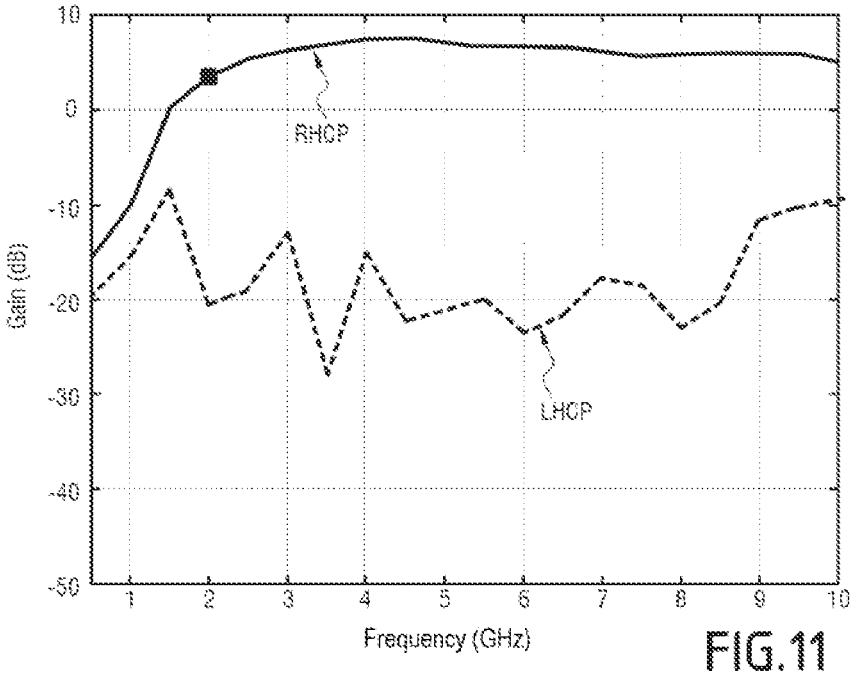
FIGS. 11 and 12 illustrate the performance of an exemplary antenna according to the fourth embodiment.
Figure 12:
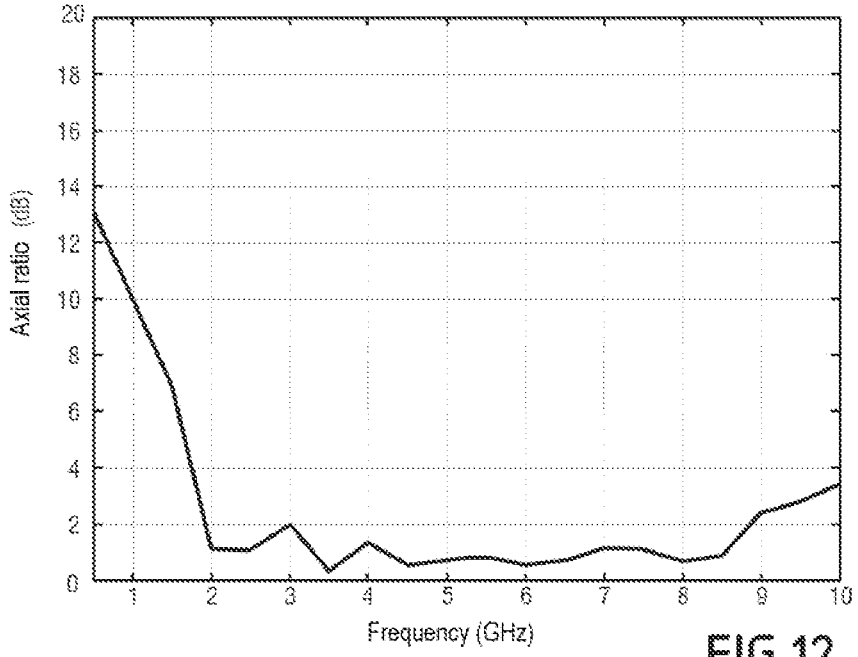

FIGS. 11 and 12 illustrate the performance of the antenna 60 with the exemplary digital values given above, in the frequency range 0.5 GHz to 10 GHz.

FIG. 11 shows the axis gain expressed in decibels as a function of frequency, for a right-hand circular polarization (RHCP) and a left-hand circular polarization (LHCP) for the exemplary antenna detailed above (theoretical circular adapted polarization RHCP).

FIG. 12 shows the axial ratio, which is the ratio in the radio axis, in decibels, as a function of frequency.

The frequency band in question is [0.5 GHz-10 GHz].

There is an improvement in the adapted polarization gain with respect to the results shown in FIG. 4, but a degradation of the axial ratio with respect to the results of FIG. 5.

This embodiment is useful if a broadband and high gain antenna is desired.

All embodiments are feasible with the topology variants of the patterns described above with reference to the first embodiment.

For all the embodiments, the resistive patterns and the peripheral resistive portions are feasible in resistive ink, by means of a simple manufacturing method, for example by screen printing, aerosol deposition or 3D printing.

Advantageously, all the embodiments described above make it possible to improve the gain performance with respect to the resistive layer antennas formed of resistive patterns with a given fixed resistance value.

The invention claimed is:

1. Wire antenna capable of operating in at least one predetermined frequency band, comprising a plurality of superimposed layers, comprising at least one radiating element placed on a support layer, wherein the support layer is placed on a spacer substrate, and wherein the spacer substrate is placed on a reflector plane, comprising at least one resistive layer between the support layer of radiating elements and the spacer substrate, wherein the resistive layer comprises at least two sets of nested resistive patterns, characterized in that the sets of resistive patterns have resistance values varying progressively between a central antenna point and an outer edge of the antenna, the at least two sets of nested resistive patterns achieving a resistance gradient, further comprising a first continuous peripheral resistive portion disposed in a peripheral zone of the resistive layer, and surrounding the resistive pattern sets of the resistive layer, and a second continuous peripheral resistive portion disposed on the support layer of the at least one radiating element and surrounding the radiating element, wherein the second portion has shape and resistance characteristics that are substantially the same as shape and resistance characteristics of the first continuous peripheral resistive portion.

2. Antenna according to claim 1, wherein the first continuous peripheral resistive portion has a circular or square crown shape.

3. Antenna according to claim 1, comprising a plurality of sets of resistive units, wherein each set of resistive patterns is composed of non-contiguous elementary resistive patterns, and has an associated resistance value, wherein the resistance value is the same for all the elementary resistive patterns of a set of resistive patterns.

4. Antenna according to claim 1, comprising a plurality of sets of resistive patterns, wherein each set of resistive patterns is composed of non-contiguous elementary resistive patterns, and wherein each elementary resistive pattern has a resistance value gradually varying over its surface, wherein the resistance variation has the same direction of variation as that of the gradual variation between the central antenna center point and the outer edge of the antenna.

5. Antenna according to claim 3, wherein all the elementary resistive patterns of the same set of patterns have the same geometric shape and are regularly spaced.

6. Antenna according to claim 1, wherein the sets of resistive patterns are concentric and have a square or circular topology.

7. Antenna according to claim 1, wherein the resistive patterns are made of resistive ink.

8. Antenna according to claim 1, comprising a plurality of resistive layers comprising sets of nested resistive patterns with resistance values gradually varying between the central antenna point and the outer edge of the antenna, wherein two successive resistive layers are separated by at least one substrate layer.

* * * * *